US008525082B2

(12) United States Patent
Englert et al.

(10) Patent No.: US 8,525,082 B2
(45) Date of Patent: Sep. 3, 2013

(54) METHOD FOR PERFORMING AN AUTOMATIC COOKING PROCESS

(75) Inventors: Carin Englert, Würzburg (DE); Florian Ruther, Steinsfeld (DE); Christoph Walther, Rothenburg ob der Tauber (DE); Dorothee Albrecht, Kirchheim (DE); Rosemarie Daub, Gerabronn (DE)

(73) Assignee: Electrolux Home Products Corporation N.V., Zaventem (BE)

( * ) Notice: Subject to any disclaimer, the term of this patent is extended or adjusted under 35 U.S.C. 154(b) by 0 days.

(21) Appl. No.: 13/092,313

(22) Filed: Apr. 22, 2011 (Under 37 CFR 1.47)

(65) Prior Publication Data

US 2012/0091120 A1 Apr. 19, 2012

Related U.S. Application Data

(63) Continuation of application No. 12/865,778, filed as application No. PCT/EP2009/000320 on Jan. 20, 2009, now abandoned.

(30) Foreign Application Priority Data

Feb. 16, 2008 (EP) ..... 08002911

(51) Int. Cl.
*H05B 1/02* (2006.01)

(52) U.S. Cl.
USPC ..... 219/486; 219/492; 219/497; 219/413; 99/328

(58) Field of Classification Search
CPC ..... H05B 1/02
USPC ..... 219/494, 497, 506, 412–414, 483–486; 99/325–333
See application file for complete search history.

(56) References Cited

U.S. PATENT DOCUMENTS

| | | | |
|---|---|---|---|
| 4,914,277 | A | 4/1990 | Guerin et al. |
| 5,990,460 | A | 11/1999 | Petty |

FOREIGN PATENT DOCUMENTS

| | | |
|---|---|---|
| CA | 1149472 | 7/1983 |
| EP | 0688146 | 12/1995 |
| EP | 0933596 | 8/1999 |
| EP | 1427256 | 6/2004 |

OTHER PUBLICATIONS

International Search Report for PCT/EP2009/000320, dated Mar. 23, 2009, 3 pages.

*Primary Examiner* — Mark Paschall
(74) *Attorney, Agent, or Firm* — Pearne & Gordon LLP

(57) ABSTRACT

The present invention relates to a method for performing an automatic cooking process in an oven, wherein the oven is in a preheated state with a first starting temperature ($T_0$) in the beginning of said automatic cooking process. The method includes the following steps of switching off at least one heating element during a cooling down period (10) and finishing the cooling down period (10) after a cooling down time ($t_{cd}$), when a predetermined first end temperature ($T_1$) has been reached. The cooling down time ($t_{cd}$) is detected. The method includes the further steps of switching on at least one heating element during a heating up period (12) and finishing the heating up period (12) after a heating up time ($t_{hu}$) and/or when a predetermined second end temperature ($T_3$) has been reached. A mathematical function (14) including the cooling down time ($t_{cd}$) and the heating up time ($t_{hu}$) is used in order to determine further parameters of the cooking process.

12 Claims, 2 Drawing Sheets

METHOD FOR PERFORMING AN AUTOMATIC COOKING PROCESS

Figure 1:
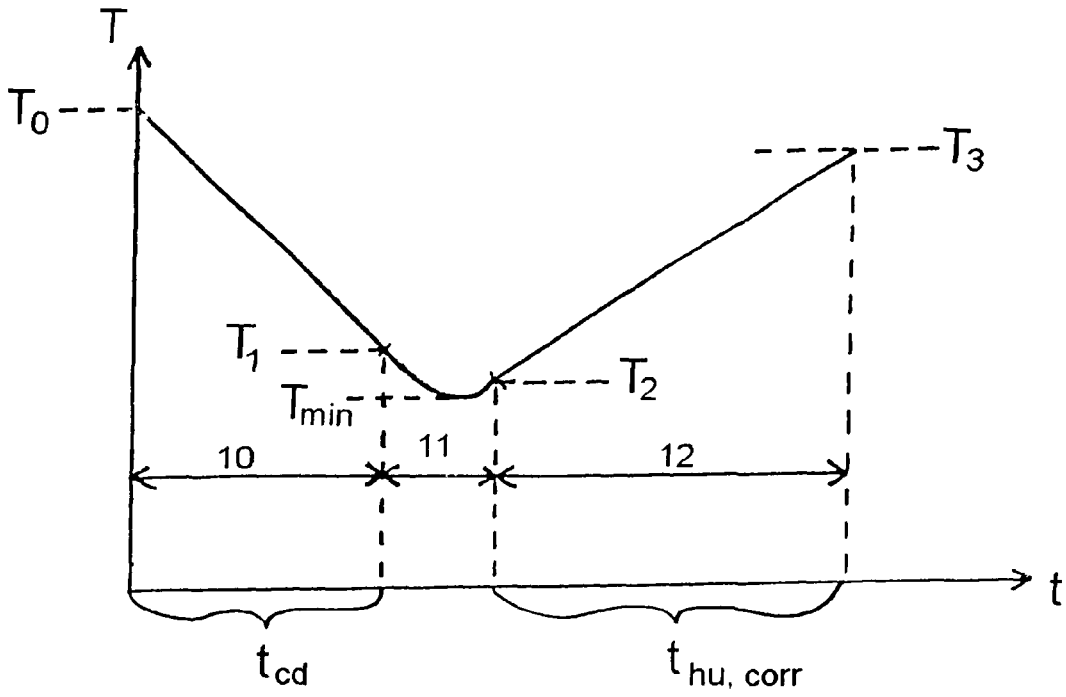

The present invention relates to a method for performing an automatic cooking process. Further, the present invention relates to an oven for performing the automatic cooking process. Additionally, the present invention relates to a control unit for performing the automatic cooking process in an oven.

A known concept for an automatic cooking system is based on the classification of the food into different food categories and measuring the time it takes to heat up the loaded oven from a start temperature to a higher threshold temperature.

In the above concept there are used two heating up times. The first heating up time ends with reaching a first threshold temperature of 83° C. The second heating up time ends with reaching a second threshold temperature of 120° C., 131° C. or 139° C. according to a chosen food category. After reaching the first temperature the remaining time of the cooking process is estimated. After reaching the second threshold temperature the remaining time of the cooking process is determined. These calculations are done by using the time until the oven has reached the threshold temperatures. By this way the mass of the food stuff inside the oven can be estimated.

The above concept allows the automatic cooking process only in such situations, when the cooking process starts at a low temperature, but not for a preheated oven. Because raising the temperature of a hot oven even more would burn the food.

It is an object of the present invention to provide a method, an oven and a control unit for performing a cooking process, which allow starting said cooking process for a preheated oven.

This object is achieved by the method according to claim 1.

According to the present invention the method for performing an automatic cooking process is provided for an oven in a preheated state with a first starting temperature in the beginning of the automatic cooking process. The method includes the following steps:

- switching off at least one heating element during a cooling down period,
- finishing the cooling down period after a cooling down time, when a predetermined first end temperature has been reached,
- detecting the cooling down time,
- switching on at least one heating element during a heating up period, and
- finishing the heating up period after a heating up time and/or when a predetermined second end temperature has been reached, and
- wherein a mathematical function including the cooling down time and/or the heating up time is used in order to determine further parameters of the cooking process.

The main idea of the invention is the use of the mathematical function using the cooling down time and/or the heating up time. The mathematical function is used to estimate and/or calculate further parameters of the cooking process like overall cooking time and temperature. This allows the automatic cooking process to start in a preheated state of the oven.

In a preferred embodiment of the present invention the value of the first end temperature is calculated from the value of the first starting temperature using a certain mathematical equation.

The value of the first starting temperature is within a range of usual cooking temperatures.

Preferably, at least one fan is activated during the cooling down period. The fan reduces the cooling down time.

Further, at least one heating element may be switched off during the cooling down period. This reduces also the cooling down time.

In order to reduce the heating up time, at least one fan may be activated during the heating up period.

For example, the food stuff is put into the preheated oven before the cooling down period begins.

Due to manufacturing tolerances different ovens will have different cool down and heat up times if empty as well as if loaded with food. To take into account those differences a calibration can be made with the empty oven and the results can be compared with stored values of a reference oven. The difference in cool down and heat up time compared to the reference oven can be used to calculate a corrected cool down and heat up time for the loaded oven.

The cooling down time depends on the heating mode that has been used before the cooling down period. Because in the different modes different heating elements are used and the different parts of the cavity are heated to a certain extent. To compensate for these influences a mathematical formula can be used to calculate the difference between the actual cooling down time and the cooling down time in a chosen reference case, i.e. when a certain heating function has been used.

After reaching the first end temperature the oven may be heated up again in order to reach the selected cooking temperature for the foodstuff.

Alternatively the oven may be heated up again in order to reach the selected cooking temperature for the foodstuff after reaching the second end temperature.

It is also possible to determine the overall cooking time from the cooling down time. In this case no further information is required. It depends on the kind of food stuff, if an additional heating up period is necessary. If the heating up period is not required, then the oven is heated up to the cooking temperature predetermined by the operation mode.

Further, the method and/or a corresponding system for performing said method is realized in hardware, software or a combination of hardware and software.

The object of the present invention is achieved by the oven. The oven is provided for the method as described above.

The object of the present invention is also achieved by the control unit. The control unit is provided for the above described method and/or for the corresponding oven.

The novel and inventive features believed to be the characteristic of the present invention are set forth in the appended claims.

Figure 2:
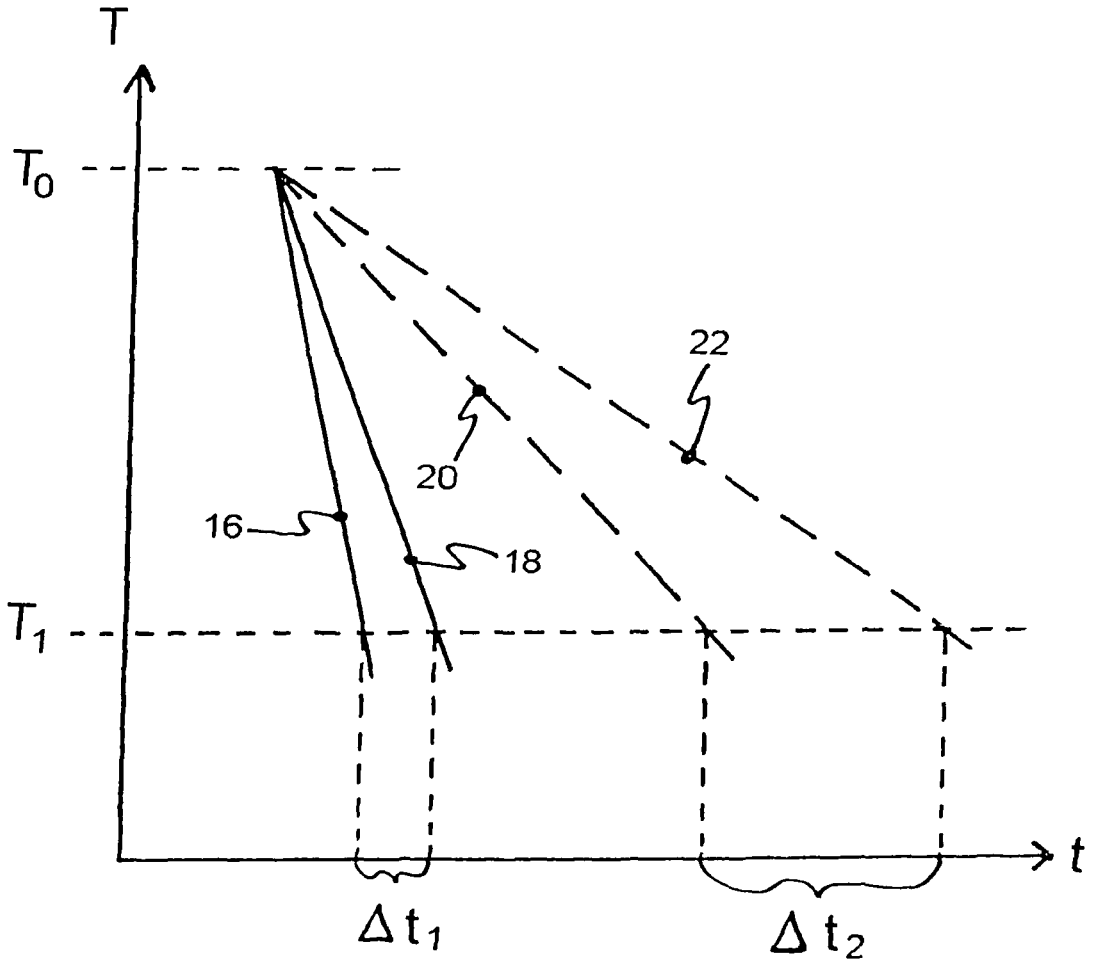

The invention will be described in further detail with reference to the drawing, in which FIG. 1 illustrates a schematic diagram of the temperature characteristics of a cooking process according to a preferred embodiment of the invention, and FIG. 2 illustrates a schematic diagram of the temperature characteristics of a cooking process according to the preferred embodiment of the invention.

FIG. 1 illustrates a schematic diagram of the temperature characteristics of a cooking process according to a preferred embodiment of the invention. The diagram shows the temperature inside the oven as a function of the time.

When the cooking process starts, a preheated oven has a first starting temperature $T_0$. The value of the first starting temperature $T_0$ is inside a range of usual cooking temperatures. At this time the food stuff may be put into the oven.

Then a cooling down period 10 begins. During this cooling down period 10 at least one heating element is switched off and at least one fan is activated.

Within a certain temperature range there is a correlation between a cooling down time $t_{cd}$ and further cooking parameters. The cooling down period 10 ends, when a predetermined first end temperature $T_1$ has been reached. The first end temperature $T_1$ is calculated by using the starting temperature $T_0$ and a certain mathematical formula. The cooling down time $t_{cd}$ is directly measured at the end of the cooling down period 10.

After the cooling down period 10 has been finished, an intermediated-period 11 begins. Said intermediated-period 11 comes about, since the heating elements are slow and delay the heating process.

When the intermediated-period 11 has been finished, a heating up period 12 begins. The heating up period 12 starts at a second starting temperature $T_2$ and finishes at a second end temperature $T_3$. The second starting temperature $T_2$ is lower than the first end temperature $T_1$, because of the slowness of the heating elements. The second starting temperature $T_2$ is the minimum temperature $T_{min}$ in this process. In this example, the second end temperature $T_3$ is about 20° C. higher than the second starting temperature $T_2$.

The temperatures of the cooling down period 10 as well as of the heating up period 12 are determined in dependence of the first starting temperature $T_0$ or the minimal temperature $T_{min}$, respectively. Thus, temperatures of the cooling down period 10 and heating up period 12 are independent of the cooking temperature. The cooking temperature is predetermined by an operation mode selected by the user.

After reaching the first end temperature $T_1$ or the second end temperature $T_3$ the overall cooking time is calculated. Then the oven heats up again in order to reach the cooking temperature for the foodstuff. Said cooking temperature is selected in the beginning of the cooking process by the oven, after the user has selected the operation mode.

FIG. 2 illustrates a schematic diagram of the temperature as function of the time during the cooling down period 10 in four different situations. A full reference curve 16 shows the behaviour of a reference oven with food stuff. A full oven curve 18 shows the behaviour of an oven to be calibrated with food stuff. An empty reference curve 20 shows the behaviour of the empty reference oven. At last, an empty oven curve 22 shows the behaviour of the empty oven to be calibrated.

For the calibration it is assumed that the gradient of the cooling down period 10 depends on the amount of the food stuff and the oven. The temperature difference arising from different starting temperatures is also taken into account for the calibration.

For the calibration the empty oven is cooled down. According to the different start temperatures a mathematical formula is used to calculate these influences considering the cooling down time of the reference oven, the cooling down time of the empty oven and the cooling down time of the oven with the food. With this mathematical formula the cooling down time of the reference oven with the food is reproduced.

The starting temperature $T_0$ and the first end temperature $T_1$ are also represented in the diagram. A first time difference $\Delta t_1$ relates to the time points, when the full reference curve 16 and the full oven curve 18 reach the first end temperature $T_1$. A second time difference $\Delta t_2$ relates to the time points, when the empty reference curve 20 and the empty oven curve 22 reach the first end temperature $T_1$.

In order to minimize the influences of the construction details of the oven a calibration should be done. Every single oven has different properties in the isolation, the closing mechanism of the door, fans and so on. Thus every oven needs a certain time to cool down.

The cooling down process of the empty oven shows a non-linearity. In order to compare the influences on the cooling down period 10 the curve 18 is recorded before the first use. The cooling down time $t_{cd}$ of the reference oven is compared with the cooling down time $t_{cd}$ of the empty oven. The end temperature $T_1$ after the cooling down period 10 is calculated. The calculated time differences can be used for the loaded ovens.

The method according to the present invention allows the start of the automatic program for the cooking process also under a warm condition. The food stuff may be put into the preheated oven and then the cooking process can be started, wherein the cooking process is controlled by an automatic program.

The cooling down time $t_{cd}$ gives information about the load of the oven within the selected food category. If the food category uses the next heating up period 12 with the corresponding heating up time $t_{hu}$ the overall cooking time can be estimated more accurate.

The present invention can also be embedded in a computer program product, which comprises all the features enabling the implementation of the method described herein. Further, when loaded in a computer system, said computer program product is able to carry out these methods.

Although illustrative embodiments of the present invention have been described herein with reference to the accompanying drawing, it is to be understood that the present invention is not limited to those precise embodiments, and that various other changes and modifications may be affected therein by one skilled in the art without departing from the scope or spirit of the invention. All such changes and modifications are intended to be included within the scope of the invention as defined by the appended claims.

LIST OF REFERENCE NUMERALS

10 cooling down period
11 intermediate-period
12 heating up period
16 full reference curve
18 full oven curve
20 empty reference curve
22 empty oven curve
$T_0$ first starting temperature
$T_1$ first end temperature
$T_2$ second starting temperature
$T_3$ second end temperature
$T_{min}$ minimum temperature
$t_{cd}$ cooling down time
$t_{hu}$ heating up time
$t_{hu,corr}$ corrected heating up time
$\Delta t_1$ first time difference
$\Delta t_2$ second time difference

The invention claimed is:

1. A method for performing an automatic cooking process in an oven, wherein the oven is in a preheated state with a first starting temperature ($T_0$) in the beginning of said automatic cooking process and the method includes the following steps:

pre-heating the oven to the first starting temperature (To) by switching on at least one heating element switching off the at least one heating element during a cooling down period (10), finishing the cooling down period (10) after a cooling down time ($t_{cd}$), when a predetermined first end temperature ($T_1$) has been reached, detecting the cooling down time ($t_{cd}$), switching on at least one heating element during a heating up period (12), and finishing the heating up period (12) which is subsequent to the cooling down period (10) after a heating up time ($t_{hu}$) and/or when a predetermined second end temperature ($T_3$) has been reached, and wherein further parameters of the cooking process are determined based on the predetermined cooling down time ($t_{cd}$) and the heating up time ($t_{hu}$).

2. The method according to claim 1, characterized in, that the value of the first end temperature ($T_1$) is predetermined based at least in part on the value of the first starting temperature ($T_0$).

3. The method according to claim 1, characterized in, that the value of the first starting temperature ($T_0$) is within a range of usual cooking temperatures.

4. The method according to claim 1, characterized in, that at least one fan is activated during the cooling down period (10).

5. The method according to claim 1, characterized in, that at least one of the heating elements is switched off during the cooling down period (10).

6. The method according to claim 1, characterized in that at least one fan is activated during the heating up period (12).

7. The method according to claim 1, characterized in, that a food stuff is put into the preheated oven before the cooling down period (10) begins.

8. The method according to claim 1, further comprising determining the overall cooking time.

9. The method according to claim 1, characterized in, that a cooking temperature is selected in the beginning of the cooking process by the oven after a user has selected an operation mode.

10. The method according to claim 1, characterized in, that after reaching the first end temperature ($T_1$) the oven is heated up again in order to reach the selected cooking temperature for the foodstuff.

11. The method according to claim 1, characterized in, that after reaching the second end temperature ($T_3$) the oven is heated up again in order to reach the selected cooking temperature for the foodstuff.

12. The method according to anyone of the preceding claims characterized in, that the method and/or a corresponding system for performing said method is realized in hardware, software or a combination of hardware and software.

* * * * *